US006827370B2

(12) United States Patent
Haramati et al.

(10) Patent No.: US 6,827,370 B2
(45) Date of Patent: Dec. 7, 2004

(54) PROTECTIVE SKI POLE

(76) Inventors: Nogah Haramati, 33 Stratford Rd., New Rochelle, NY (US) 10804; Joseph Margulies, 8 Usonia Rd., Pleasantville, NY (US) 10570

( * ) Notice: Subject to any disclaimer, the term of this patent is extended or adjusted under 35 U.S.C. 154(b) by 0 days.

(21) Appl. No.: 10/160,675

(22) Filed: Jun. 3, 2002

(65) Prior Publication Data

US 2003/0222453 A1 Dec. 4, 2003

(51) Int. Cl.[7] ..... A63C 1/22
(52) U.S. Cl. ..... 280/819; 280/821
(58) Field of Search ..... 280/809, 819, 280/823, 821; 135/73, 77, 78, 81

(56) References Cited

U.S. PATENT DOCUMENTS

| | | | | | |
|---|---|---|---|---|---|
| 2,596,733 | A | * | 5/1952 | Sibner | 280/823 |
| 3,269,743 | A | * | 8/1966 | Barreca | 280/819 |
| 3,556,544 | A | * | 1/1971 | Hauser et al. | 280/823 |
| 3,797,845 | A | | 3/1974 | Kebka et al. | 280/11.37 B |
| 4,229,016 | A | | 10/1980 | Wolf | 280/821 |
| 4,332,399 | A | | 6/1982 | Kepple | 280/819 |
| 4,343,490 | A | * | 8/1982 | Adamson | 280/821 |
| 4,597,589 | A | | 7/1986 | Fujii et al. | 280/821 |
| 5,139,283 | A | * | 8/1992 | Dow et al. | 280/819 |
| 5,320,386 | A | * | 6/1994 | Harmala et al. | 280/819 |
| 6,070,907 | A | | 6/2000 | Bujold et al. | 280/821 |
| 6,082,767 | A | | 7/2000 | Bujold et al. | 280/819 |
| 6,203,063 | B1 | | 3/2001 | Bujold et al. | 280/819 |
| 6,361,451 | B1 | * | 3/2002 | Masters et al. | 473/318 |
| 6,394,116 | B1 | * | 5/2002 | Winn et al. | 135/65 |

* cited by examiner

*Primary Examiner*—Brian L. Johnson
*Assistant Examiner*—Bridget Avery
(74) *Attorney, Agent, or Firm*—Leonard Cooper

(57) ABSTRACT

The ski pole has normal strength when the pole is normally gripped at its handle and reduced strength when not gripped. The poles permanently deform when a predetermined level of excessive bending force is applied. The pole shaft is hollow with a short circumferential segment having reduced cross-section. When the handle is gripped, a plug slideable within the shaft spans the reduced cross-section and reinforces the pole at that region. When the handle is not gripped, the plug slides away from the reduced wall segment and reduces pole strength. A button on the handle connects to the plug by a rod, cable, hydraulics, pneumatics, etc. Alternatively, button actuation electrically drives a magnetic solenoid to move the plug. The weakened portion is replaceable so the pole is reusable.

16 Claims, 4 Drawing Sheets

(PRIOR ART)

PROTECTIVE SKI POLE

BACKGROUND OF THE INVENTION

This invention relates generally to ski poles of the type used in downhill and cross-country skiing by both amateurs and skilled athletes, and more particularly to a ski pole having features intended to reduce the hazards of injury to the thumbs of the skier. Gamekeeper fracture of the thumb and Stener lesion are the second most common trauma of skiers. The ulnar collateral ligament is torn and the ends distracted allowing an aponeurosis to interpose itself between the torn ends of the ulnar collateral ligaments. This interposition prevents the normal healing of the ulnar collateral ligament and causes long term disability with disorders of pinch and grip. The damage occurs upon high impact collision between the ski pole and the thumb where the skier normally grips the pole. The damage occurs most frequently during falls or loss of balance events, when the ski pole is loosely held and is suddenly accelerated relative to the hand that holds it. Extension of the thumb occurs when there is loss of grip on the ski pole.

The Stener lesion is believed to be avoidable if the pole is firmly gripped by the skier's hand when the fall or loss of balance occurs, and/or if the direction of the kinetic energy can be directed along a vector that is different from that which causes hyperabduction of the thumb. An important condition in the development of a situation that leads to such a hand injury is that the ski pole has become fixed at its pointed tip, either in the snow, under the ski blades, or in any other obstacle that may present itself on the skier's path. While losing his balance and falling, the skier generally loses the tight grip on the pole handle, which is normal during skiing and thus creates the conditions for violent hyperabduction of the thumb.

The problem was recognized and a solution proposed in U.S. Pat. No. 4,229,016 to Wolf. Therein a mechanism allows the handle to pivot relative to the extended shaft of the ski pole when a certain force is applied to the handle relative to the pole shaft. The forces required to cause the handle to pivot may be pre-selected such that the handle hopefully pivots before the thumb is injured. The handle may later be restored to its longitudinal position and the pole is again in condition for use.

Three patents to Bujold, U.S. Pat. Nos. 6,070,907; 6,082,767; and 6,203,063, disclose a ski or hiking pole having an articulated handle. The handle pivots relative to the shaft under high bending stress. An internal spring mechanism restores the pole to its normal configuration when the stress is no longer present.

Fuji, U.S. Pat. No. 4,597,589, provides a handle that is pivotable to a right angle with the shaft so that a skier may push off with a greater force at the start of a downhill run. The handle pivots when the user presses a button on the handle and a spring returns the handle to its normal position when the button is released.

Kepple, U.S. Pat. No. 4,332,399, provides a ski pole with a shaft in two portions. The upper portion is connected to the lower portion by a coil spring that bends only under high bending forces. The handle may also be spring-connected to the top of the shaft.

Kepka, U.S. Pat. No. 3,797,845, provides an extended history of ski poles designed to lessen the dangers of injury. His particular construction provides a shaft in two portions that telescope on each other when axial force on either end exceeds a preselected value. The pointed tip can also telescope. The primary concern is with skier impalement by the pole, and bending and thumb injuries are not considered. In all embodiments, the pole returns to its original condition when axial forces are removed.

In spite of prior recognition of the problem, thumb injuries, as stated, remain as the second most common skier injury. It is suspected that many thumb injuries go unreported although the consequences can be serious and at times permanent.

Mechanisms proposed for incorporation in ski poles in the earlier patents were complex and presumably costly to produce. Applicant is unaware of any commercially available ski pole that incorporates safety features to protect against thumb injury. What is needed is a protective ski pole that reduces the likelihood of thumb injury in those situations as described above where the skier momentarily loosens his grip on the ski handle while the tip of the ski pole is fixedly engaged in the snow or in some unexpected obstacle.

SUMMARY OF THE INVENTION

Generally speaking, in accordance with the invention, a ski pole less likely to cause thumb injuries to a skier is provided. The ski pole has normal strength when the pole is normally gripped at its handle and has reduced strength, is weakened, when the handle is not gripped. It should be understood that the pole is not so weak as to impair its utility when the handles are not gripped. A skier skis normally and does not have to continuously squeeze the pole handles to prevent failure of the poles. The poles are intended to break or permanently bend when a pre-determined level of excessive force is applied, as may happen in the emergency situations described above.

The poles are provided with a weakened section along their length. Desirably, the pole will fail in bending at the weakened section in an emergency situation prior to injury of the thumb. Reinforcement is provided for the weakened section whenever the pole handle is conventionally gripped by the person, but there is no reinforcement when the grip is released. Thus the ski pole has available two levels of bending strength and the skier selects the operating level either by intent or instinct in an emergency by his/her grip on the ski pole handle.

In a preferred embodiment, the pole shaft is a hollow tube with a short circumferential segment of the tube wall having a reduced cross-section. When the handle is gripped, a piston or plug slidable within the tube is aligned to span the reduced cross-section and reinforce the pole at that region. When the handle is not gripped, the piston slides away from the reduced wall segment and reduces the strength of the pole. A button on the handle connects to the sliding piston by a rod, cable, hydraulics, pneumatics, etc. Alternatively, actuation of the button may initiate an electrical sequence that actuates a magnetic solenoid to move the reinforcing piston. The weakened portion of the pole may be a replaceable section so the pole is reusable, and a particular pole may be calibrated to fail in bending at a pre-selected force.

Accordingly, it is an object of the invention to provide an improved protective ski pole that is strong when in normal use and becomes weaker in bending in an emergency situation wherein the skier releases his tight grip on the pole handle.

A further object of the invention is to provide an improved protective ski pole that is simple in construction and has two states, a stronger state and a weaker state.

It is a further object of the invention to provide an improved protective ski pole that is maintained with readily replaceable parts so that it may quickly be returned to use after occurrence of an emergency event.

Still other objects and advantages of the invention will be apparent from the specification. The invention accordingly comprises the features of construction, combination of elements, an arrangement of parts, which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

The Figures are not drawn to any scale.

DESCRIPTION OF PREFERRED EMBODIMENTS

Figure 1:
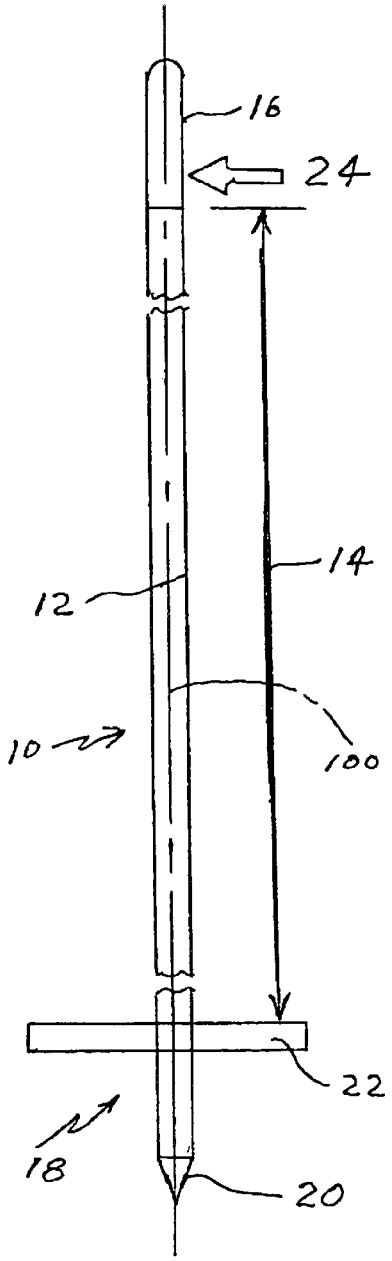
FIG. 1 is a conventional ski pole.

With reference to FIG. 1, a conventional ski pole 10 includes a shaft 12 of extended length 14 connected to a handle 16 at one end of the shaft and to a tip assembly 18 at the other end of the shaft 12. The tip assembly has a pointed tip 20 longitudinally aligned to the shaft axis 100 and a transverse web 22, as is well known in the construction of ski poles. The tip assembly is used, for example, to limit penetration of the shaft into the snow during skiing, for example when turning, and the handle 16 is gripped by the skier when performing on skis. When the tip assembly 18 becomes fixed in place for reasons described in the Background of the Invention above, forces on the handle 16 and along the shaft length 14 tend to put the shaft in bending stress as in a cantilever beam. When a transverse force as indicated by the arrow 24 is applied to the handle 16, the bending stresses within the shaft 12 increase and are maximum at the fixed end of the shaft where it joins the tip assembly 18. Thus, as the force at 24 is increased, it would be expected that a shaft 12 of uniform cross-section along its length would fail at the fixed base proximate the web 22.

Along the length of ski pole 26 (FIG. 2) in accordance with the invention, the shaft 28 has a safety element 30 generally of a diameter similar to that of the adjacent shaft portions. The safety element 30 has a narrowed cross-section 32. A nipple 34 threads into the lower end 36 and a similar nipple 35 with a through opening 38 threads into the upper end 40 of the safety element 30. Thus, a hollow space 42 is provided within the safety element 30. In the hollow space, a strong cylindrical plug 44, e.g. steel, is slidable between the nipples 34, 35, with a close fit against the internal wall 46 of the hollow space 42. A return spring 48 between the plug 44 and lower nipple 34, biases the plug 44 toward the nipple 35. A vent hole 50 through the wall of the safety element 30 ensures ambient pressure in the hollow space 42 regardless of the position of the plug 44. Alternatively, an opening (not shown) is provided longitudinally through the nipple 34 and a vent passage is provided in the shaft 28 at a location below the safety element 30.

The handle 52 has an upper end with a socket 54 sunk therein. A push button 56 sits in the socket 54. The push button 56 and socket 54 have corresponding cross-sectional contours to provide a sliding fit. A rod 58 of rigid material, for example, steel, connects between the push button 56 and the plug 44 by way of a hollow space 60 in the shaft 28 and handle 52 and passing through the opening 38 in the upper nipple 35.

In use of the ski pole, the gloved skier tightly grips the handle 52 and depresses the button 56, for example, with his thumb, such that the plug 44 is driven down (FIG. 2) by the rod 58 from its illustrated first position to a second position where the plug straddles the portion 32 of narrowed cross-section in the safety element 30. Thus, the plug 44 reinforces the narrowed cross-section 32 while the skier depresses the button 56. The coil spring 48 is compressed between the plug and the nipple 34 in the process.

In an emergency situation as described above, where the tip assembly of the ski pole 26 becomes undesirably fixed in place causing the skier to begin a fall, it is instinctive that the skier will release his tight grip on the handle 52 and button 56. The skier may also release the button by intent in such a situation if he has the presence of mind. When the button 56 is released, whether or not the skier is still gripping the body of the handle 52, the spring 48 expands and returns the plug to the first position, illustrated in FIG. 2. Thereby the narrowed cross-section 32 is no longer reinforced, and the pole 26 is in a relatively weakened state, subject to failure more readily than when the button 56 is depressed.

The ski pole 26 and the safety element 30 may be made of metal or plastic or of a reinforced composition of plastic and, for example, fibers. A good sliding fit with low friction is provided between the plug 44 and the inner wall 46 as a result of the finish on the mating surfaces. Alternatively, the surfaces may be lubricated, or the plug may be coated with or fabricated from a self-lubricating material. The plug 44 may have a truncated, conical lower end to assure positive contact within the coils of the spring 48.

In every embodiment of the invention, whether or not particularly disclosed herein, weakening the cross-section need not be provided by the necked-in portion 32 but may be produced instead by notches or grooves (not shown) circumferentially encircling the safety element 30 and recessed into the wall thereof. In place of the reduced cross-section 32, the wall of the safety element 30 may be pierced radially by a series of holes (not shown) spaced circumferentially around the element. If the element 30 is fabricated from plastic or a reinforced composite, etc., a section may be weakened by a change in the plastic composition in that region or by a reduction of, for example, reinforcing fibers in a plastic matrix at that region.

In all of the variations, an inventive concept lies in a portion of the ski pole where there is a weakened segment that can be reinforced in normal use of the ski pole and that is weakened when the ski pole handle is not tightly gripped.

The safety element 30 may be disengaged in its entirety from the ski pole by unthreading it from the nipples 34, 35 and may be replaced by a new element 30 after an event that damages the present emergency element 30. Or the element 30 may be replaced with another safety element that has a different degree of weakening in order to produce a protective response at another level of bending stress. Preferably, in removing a safety element 30 from a ski pole, the nipples 34, 35 are removed at the same time and the replacement unit includes new nipples 34, 35 such that possible contamination of the inner surfaces of the replacement safety element 30 is avoided. Flats (flat surfaces) may be provided on the outside of the safety element 30 near the ends 36, 40, on the outer surfaces of the nipples 34, 35, and on the outer surfaces of the adjacent portions of the ski pole 26 so that tight connections may readily be made using a simple wrench or pliers.

Figure 3A:
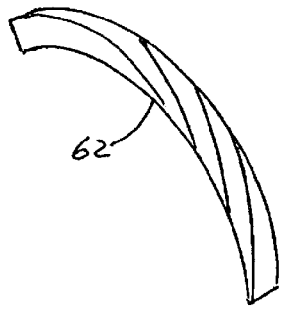
FIGS. 3*a–c* are variations of mechanical actuation components in accordance with the invention.
Figure 2:
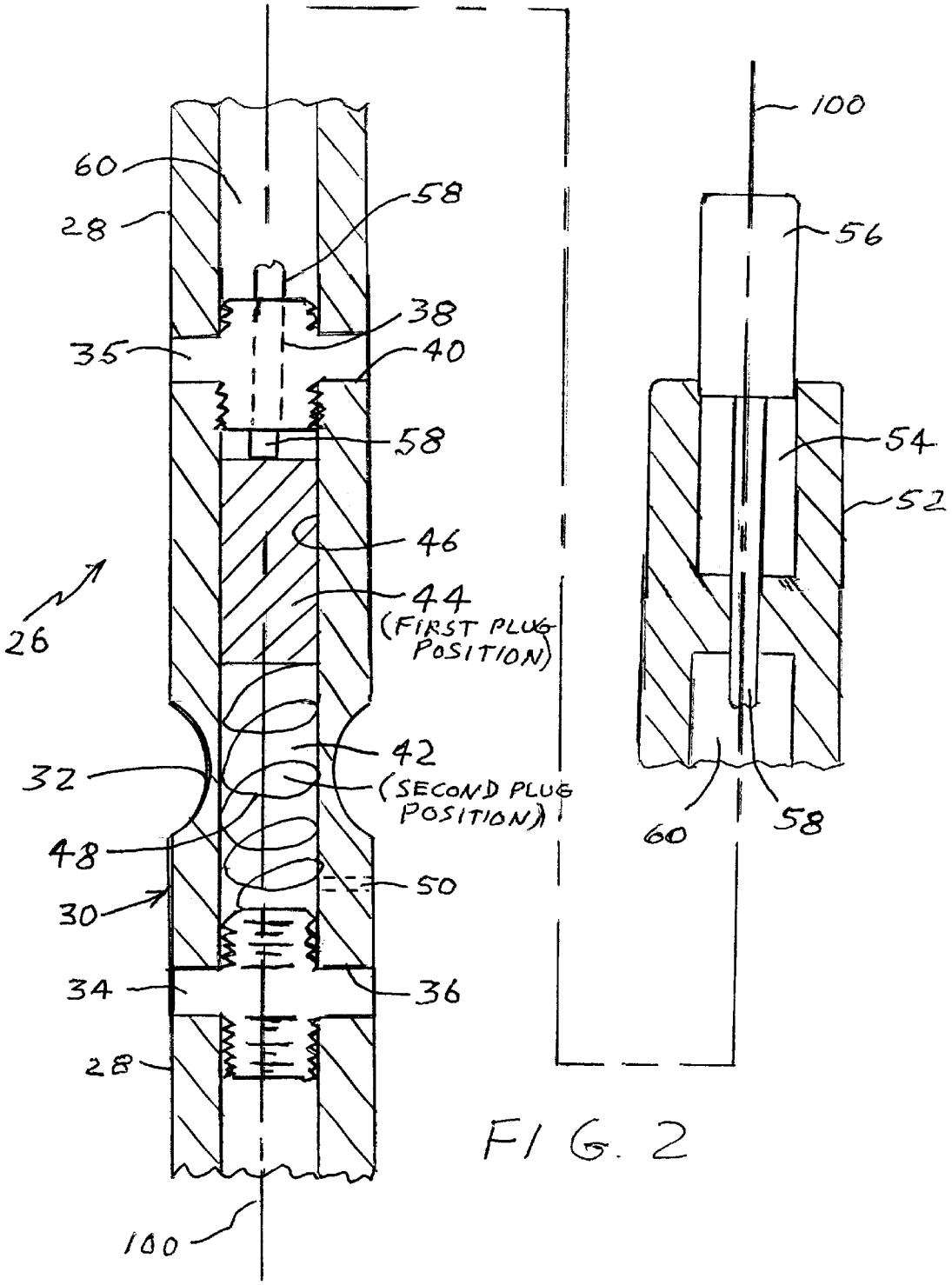
FIG. 2 is a segment in partial cross-section of an embodiment of a ski pole in accordance with the invention.

Although a rigid rod 58 was illustrated in FIG. 2 as the mechanical transmission element between the button 56 at the handle 52 and the plug 44 in the safety element 30, other connections may be used. For example, a flexible control cable 62 whether twisted or woven, etc., may be used (FIG. 3*a*). A column of rigid balls 64 (FIG. 3*b*) may be used to fill the space 60 between the button 56 and the plug 44. The force applied to depress the button 56 is transmitted through the contacting balls to move the plug.

Figure 3B:
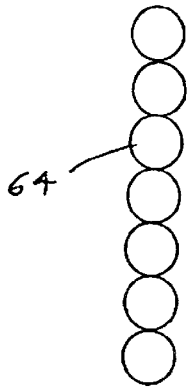
Figure 3C:
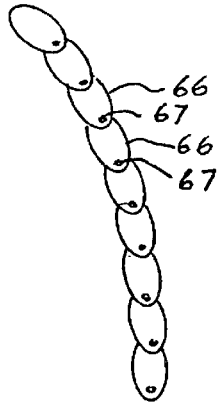

In another variation, articulated links 66 (FIG. 3*c*), hinged with pins 67, extend between the button 56 and the plug 44. In each variation, pressing on the push button 56 causes the plug 44 to move to span the weakened region 32 (or its equivalent as discussed above). When pressure is no longer applied to the button 56, the return spring 48 restores the original positions of the actuation mechanism and the pole reverts to its weakened state. The linkages of FIGS. 3*a–c* are attractive when the ski pole has some curvature to it. These mechanisms operate effectively around curves although excessive slack in these mechanisms that might allow kinking is to be avoided.

The actuation mechanism may be simplified by locating the safety element 30 close to the handle 52. However, stresses induced by bending when the ski tip is fixed by an obstacle, are greatest near the ski tip. Thus, location of the safety element 30 along the length 14 of the shaft 28 is only determinable when the shaft materials, diameter, shaft length, etc., are known. Then, safety elements 30 may be produced having a range of forces that will result in mechanical failure of the ski pole at the safety element 30.

Figure 4:
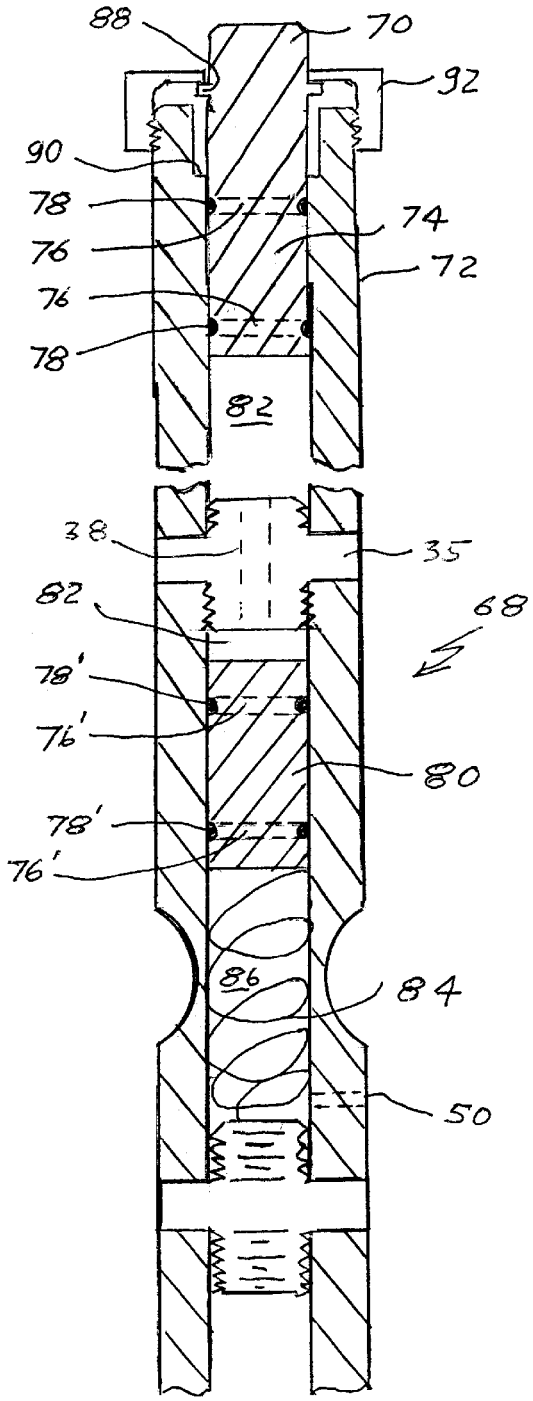
FIG. 4 is a segment in partial cross-section of an alternative embodiment of a ski pole in accordance with the invention.

In alternative embodiments of a completely mechanical construction as shown in FIGS. 2 and 3*a–c*, variations may be provided. For example, a lock (not shown) may be provided so that the button 56 is maintained in the selected out or in position permanently or until released by the user. A retaining cap may be provided so that the push button 56 is never separated (as illustrated in FIG. 4 for another embodiment hereinafter) from the handle. The rod 58 need not be of rigid material but may be flexible and resilient so long as it is stiff enough to transmit the desired forces from the push button 56 to the plug 44, for example, hard rubber.

Figure 5A:
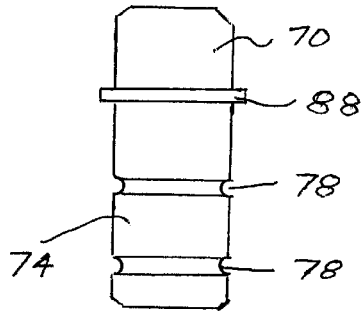
FIGS. 5*a* and *b* are construction details of the embodiment FIG. 4.
Figure 5B:
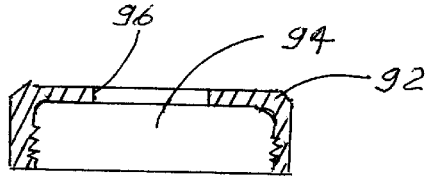

In another embodiment of a ski pole according to the invention (FIGS. 4, 5*a,b*), the mechanical actuation mechanism of FIG. 2 is replaced by a fluid linkage. The button 70 on the handle 72 is connected to a piston 74 that slides within the handle 72 with a sealed fit that is effected by "O" rings 76 that fit within grooves 78 provided on the piston 74. The plug 80 is also a piston sealed to the inner walls of the ski pole shaft by means of "O" rings 76' and grooves 78'. The otherwise hollow space within the shaft and handle between the piston 74 and plug 80 is filled with fluid 82. The nipple 35 provides leak tight connections.

When the fluid 82 is incompressible, for example, an automotive coolant for below freezing temperature operation, depressing the button 70 causes the piston 80 to move down (FIG. 4) while compressing the spring 84, as described in relation to FIG. 2. The spring 84 operates in a vented space 86 having the opening 50. The distance that the piston 74 travels relative to the distance that the plug 80 travels depends inversely upon the diameters of the two pistons.

When the fluid 82 is a gas, for example, air, the operating results are substantially the same except that the response to actuation of the button 70 may be slightly delayed and spongy due to compression of the gas.

To assure a good seal for the pistons and to prevent damage to the "O" rings, the inside wall surface and any contact between the walls and pistons ("O" rings) must have smooth surfaces and lubrication may be desirable. Where a good sliding fit is provided by including lubricant or surface coatings as necessary, it is possible to eliminate the "O" rings 76 and grooves 78 on one or both pistons. A fluid refill port (not shown) may be provided to allow addition and removal of fluid 82 between the pistons.

A flange 88 on the button 70 rests against the shoulder 90 in the handle 72 when the button is fully depressed thereby limiting travel of the button in driving the piston 74. A cap 92 with a central opening 94 is threaded to the handle 72. The periphery 96 of the opening 94 also engages the flange 88 to prevent inadvertent escape of the button 70 and piston 74 from the handle 72. Thus, travel of the button 70 is limited between the shoulder 90 and periphery 96 of the central opening 94. A return spring (not shown) may be used between the flange 88 and the shoulder 90 to facilitate release of the button and change in the operating state of the ski pole 68.

Figure 6:
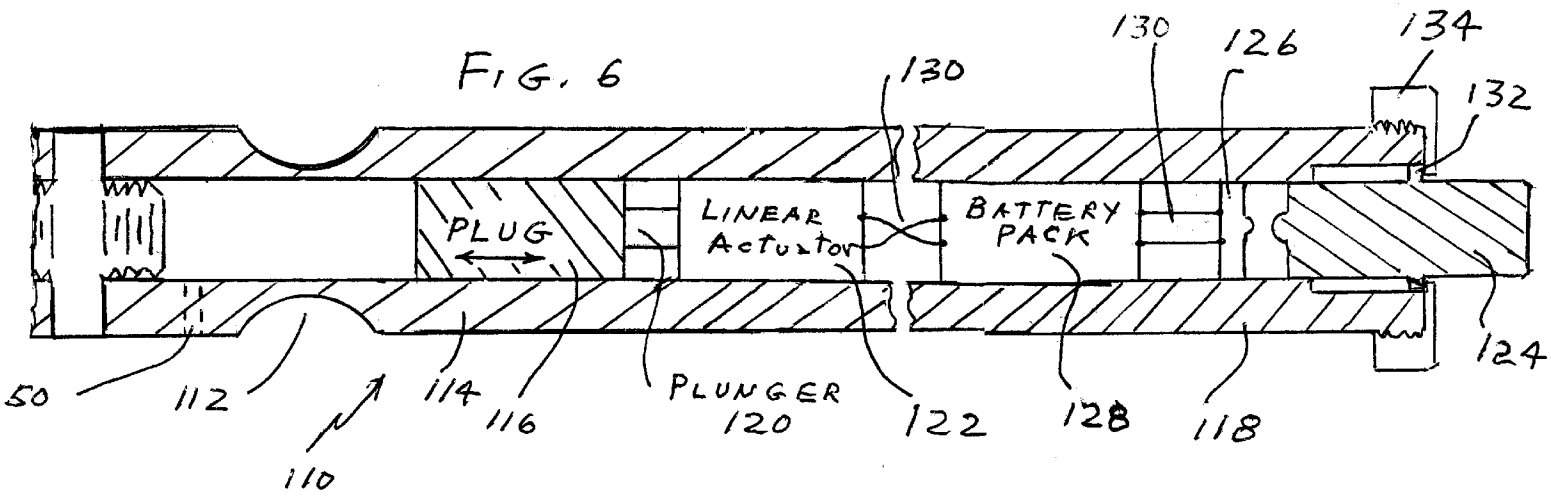
FIG. 6 is a segment in partial cross-section of another alternative embodiment of a ski pole in accordance with the invention.

FIG. 6 illustrates a ski pole 110 in accordance with the invention, which operates electrically/electronically to provide the two safety states of the device. Similar to the embodiments described above, the narrowed section 112 is straddled by the plug 116 and reinforced thereby from within the shaft 114 during normal skiing conditions. In an emergency where the skier releases his grip on the handle 118, the plug is moved and the ski shaft is no longer reinforced at section 112. In the present construction, the plug 116 connects to the plunger 120 of the linear actuator/electrical solenoid 122.

When the button 124 on the handle 118 is depressed by the skier, a switch 126 is closed and a circuit between a battery pack 128 and the handle 118 is completed through conductors 130 to the linear actuator 122. Motion of the button 124 is limited in both directions by a flange 132 on the button 124 and a cap 134 with a construction similar to that described above and shown in FIGS. 4 and 5*a, b*.

Figure 7:
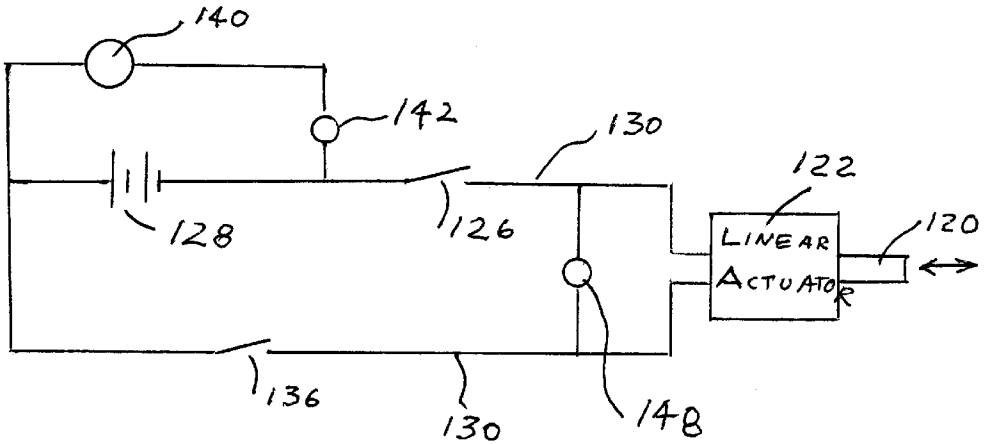
FIG. 7 is an electrical schematic associated with the ski pole of FIG. 6.

FIG. 7 illustrates schematically the linear actuator 122 and plunger 120 connected by leads 130 to the battery pack 128, with the skiing switch 126 in position to make and break a complete circuit. Additionally, an on/off switch 136 is in circuit so that the battery 128 is not inadvertently drained when the skis are not in use or are in storage. The batteries 128 would be a rechargeable type preferably, and contacts for recharging the battery 128 while it is in the handle 118 may be provided. When on the slopes, a skier would place the switch 136 in the On position. A LED 140, placed in parallel with the battery 128, lights up to indicate the strength of the battery when the user presses the button 142. A safety LED 148, placed in parallel with the input to the linear actuator 122, provides an indication when voltage is actually On at the linear actuator 122.

A time delay circuit (not shown) may operate between the battery 128 and linear actuator 122 so that response of the plunger 120 is not instantaneous, and every momentary nervous actuation of the button 124 by the skier does not result in operation of the linear actuator 122. Such a circuit may be beneficial in reducing unnecessary drain on the battery, and the time between recharging and replacing the battery may be extended.

In alternative embodiments in accordance with the invention, the hard-wired construction of FIGS. 6 and 7 may be replaced with more sophisticated signal transmission systems. For example, actuation of the button 124 by the skier may produce an optical, acoustic, or radio frequency signal at the handle 118. The signal travels through the hollow space of the ski pole 114 and is detected by an appropriate sensor connected to circuitry that energizes the linear actuator 122. Such techniques are now used frequently, for example, in the home in television remote controls, appliance remote controls, controls for automatic garage doors, etc., and implementation would present no obstacle to those skilled in the electronic arts.

Further, it should be understood that the battery pack 128 may be external to the ski pole shaft and handle and may also be located in the gloves of the skier with provision of proper electrical connection to the linear actuator.

In alternative embodiments, the nipples 34, 35 used as connections to provide a replaceable safety element, may be replaced by bayonet type connectors conventionally used in electronic devices. Thus, a simple twisting action can provide a strong and releasable connection.

Although all of the above described embodiments include a button on the handle that is pressed by the skier in order to change the operating state of the ski pole, it should be understood that actuation of the safety feature in the ski pole is not limited to a push button. For example, a lever type triggering mechanism may be used for operating with a handle in a manner similar to that found on handlebar brakes of a bicycle. The skier would squeeze the brake handle relative to the ski pole handle to provide actuation. Release of the safety handle would place the ski pole in its weaker condition.

In the embodiments relying entirely on mechanical mechanisms (FIGS. 2, 3*a–c*), the plug 44 may be eliminated and the column of balls 64 and articulated links 66 in respective embodiments may extend to span the reduced cross-section 32 continuously during operation. When the button 56 is not depressed, the balls 64 or links 66 easily move relative to each other and provide little resistance to bending of the pole. However, when the button 56 is depressed, the balls 64 and the links 66 become rigidized reinforcing columns in compression (when the lower end of the chain of balls or links is fixed by an internal stop) within the ski pole shaft 30.

Similarly, a column of balls (not shown) that are on a flexible cable that threads through a hole in each ball (like pop-it beads), can be placed in compression by putting tension on the cable. This rigidizes the string of pop-it-like balls.

When the balls and links provide a close fit within the ski pole shaft, they provide reinforcement for the ski pole wall when the balls or links are in compression to form a rigidized element.

In other embodiments of the invention the weaker portion may be reinforced by actuation of the handle trigger mechanism to internally pressurize the weakened portion. The piston construction of FIG. 4 when depressed, may pressurize the pole interior when the hollow space is leak tight. Alternatively a balloon located at the weakened portion of the shaft may be inflated when the handle button is depressed to provide only a local reinforcement.

In each of the above embodiments, a relaxed grip at the handle provides the weakened state of the pole. It should be readily understood that this type of operation can be reversed such that a relaxed grip provides a stronger condition of the pole. This reversed operation can be accomplished in further alternative embodiments (not shown) that position the reinforcement at the weakened section of the pole when the normal grip at the handle is relaxed. For example, such a construction may be used in a fishing pole where the person desires a more flexible pole when firmly gripping the handle and casting his line. Then, a more rigid pole can be provided when reeling in the catch.

As stated above in all embodiments, a pole is provided that operates in one of two available states, namely the weaker or stronger state.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What is claimed is:

1. A ski pole having a selectable bending strength, comprising:

a shaft of extended length having a first end and a second end, said shaft including at least a first portion and a second portion connected as parts of said extended shaft length;

a handle connected to said first shaft end for manual gripping by a person;

a displaceable reinforcement unit, in a first position of said reinforcement unit said first shaft portion having a greater strength in bending before permanent mechanical failure of said pole occurs than said second portion, failure including at least one of fracture and permanent deformation, in a second position of said reinforcement unit said second shaft portion being reinforced by said reinforcement unit, said pole having an increased strength in bending before permanent mechanical failure occurs when said reinforcement unit is in said second position; and an actuating mechanism for displacing said reinforcement unit between said first position and said second position, wherein said second portion includes a weaker cross-section as compared to a cross-section of said first portion, said reinforcement unit adding area to said weaker cross-section in said second position of said reinforcement unit to increase the bending strength of said second portion and said pole.

2. A ski pole as in claim 1, further comprising a tip assembly connected to said second shaft end for engaging a snow surface.

3. A ski pole as in claim 1, wherein said actuating mechanism includes a trigger mounted to said handle for actuation by said person.

4. A ski pole as in claim 3, wherein said trigger is connected to said reinforcement unit by at least one of mechanical structure, fluid linkage, and electrical circuits and devices.

5. A ski pole as in claim 3, wherein said trigger is connected to said reinforcement unit by at least one of a rigid rod, contacting balls, linked members, cable, and a flexible rod.

6. A ski pole as in claim 3, wherein said trigger and reinforcement unit are mechanically connected, said second portion includes hollow space, said reinforcement unit includes a sliding plug in said space, said reinforcement unit being connected to said trigger by said mechanical structure including at least one of a rod, flexible cable, ball column, and articulated column within said shaft, actuation of said trigger by said person causing said reinforcement unit to be located by said structure in said reinforcing second position, release of said trigger by said person causing said reinforcement unit to be located in said non-reinforcing first position.

7. A ski pole as in claim 3, wherein said trigger and reinforcement unit are connected by fluid linkage, said shaft including a hollow space between said handle and said second portion, said trigger connecting to a slidable first piston sealed with walls of said hollow space, said reinforcement unit including a second piston sealed to said walls of said hollow space, actuating said trigger moving said first piston to pressurize fluid in said hollow space of said shaft and causing said second piston to move to said reinforcing second position, release of said trigger by said person causing said reinforcement unit to be located in said non-reinforcing first position.

8. A ski pole as in claim 3, wherein said trigger and reinforcement unit are connected by electrical circuits and devices, said second shaft portion includes a hollow space, said reinforcement unit includes a sliding plug in said hollow space, said circuits and devices including a linear actuator actuated by voltage applied thereto and connected to said plug, said voltage being applied and removed by operation of said trigger, release of said trigger by said person causing said actuator to move said reinforcement unit to said non-reinforcing first position, actuation of said trigger causing said reinforcement unit to be in said reinforcing second position.

9. A ski pole as in claim 3, wherein said trigger includes a slidable button extending in a pre-actuation state from said handle.

10. A ski pole as in claim 6, wherein said sliding plug is moved in opposition to a returning force.

11. A ski pole as in claim 7, wherein said trigger actuation causes at least one of said first and second pistons to move in opposition to a returning force.

12. A ski pole having a selectable bending strength, comprising:

a shaft of extended length having a first end and a second end, said shaft including at least a first portion and a second portion connected as parts of said extended shaft length;

a handle connected to said first shaft end for manual gripping by a person;

a displaceable reinforcement unit, in a first position of said reinforcement unit said first shaft portion having a greater strength in bending before permanent mechanical failure of said pole occurs than said second portion, failure including at least one of fracture and permanent deformation, in a second position of said reinforcement unit said second shaft portion being reinforced by said reinforcement unit, said pole having an increased strength in bending before permanent mechanical failure occurs when said reinforcement unit is in said second position;

an actuating mechanism for displacing said reinforcement unit between said first position and said second position, said actuating mechanism including a trigger mounted to said handle for actuation by said person, and said trigger is connected to said reinforcement unit by at least one of liquid and gas.

13. A ski pole having a selectable bending strength, comprising:

a shaft of extended length having a first end and a second end, said shaft including at least a first portion and a second portion connected as parts of said extended shaft length;

a handle connected to said first shaft end for manual gripping by a person;

a displaceable reinforcement unit, in a first position of said reinforcement unit said first shaft portion having a greater strength in bending before permanent mechanical failure of said pole occurs than said second portion, failure including at least one of fracture and permanent deformation, in a second position of said reinforcement unit said second shaft portion being reinforced by said reinforcement unit said pole having an increased strength in bending before permanent mechanical failure occurs when said reinforcement unit is in said second position;

an actuating mechanism for displacing said reinforcement unit between said first position and said second position, said actuating mechanism including a trigger mounted to said handle for actuation by said person, and said trigger is connected to said reinforcement unit by electrical circuits and devices including at least one of electrically conductive paths, optical light paths, sound transmission and RF transmission paths.

14. A ski pole having a selectable bending strength, comprising:

a shaft of extended length having a first end and a second end, said shaft including at least a first portion and a second portion connected as parts of said extended shaft length;

a handle connected to said first shaft end for manual gripping by a person;

a reinforcement unit, in a first state of said reinforcement unit said first shaft portion having a greater strength in bending before permanent mechanical failure of said pole occurs than in said second state, failure including at least one of fracture and permanent deformation, in a second state of said reinforcement unit said second shaft portion being reinforced by said reinforcement unit, said pole having an increased strength in bending before permanent mechanical failure occurs when said reinforcement unit is in said second state; and an actuating mechanism for switching said reinforcement unit between said first and second state, wherein said second portion includes a weaker cross-section as compared to a cross-section of said first portion, said reinforcement unit adding area to said weaker cross-section in said second position of said reinforcement unit to increase the bending strength of said second portion and said pole.

15. A ski pole as in claim 14, wherein said actuating mechanism includes a trigger mounted to said handle for actuation by said person.

16. A ski pole as in claim 15, wherein said trigger is connected to said reinforcement unit, said reinforcement unit including at least one of a column of balls, articulated links, and beads strung together, and extending in said first state flexibly from said trigger to a position adjacent to said weaker cross-section, actuation of said trigger by said person causing said balls, links, and beads to be rigidized relative to each other to reinforce said weaker cross-section in said second state.

* * * * *